US008297000B1

(12) United States Patent
Demartini

(10) Patent No.: US 8,297,000 B1
(45) Date of Patent: Oct. 30, 2012

(54) RAIN GUTTER COVER

(75) Inventor: Robert J. Demartini, Flat Rock, NC (US)

(73) Assignee: Drainage Products, Inc., Acton, MA (US)

( * ) Notice: Subject to any disclaimer, the term of this patent is extended or adjusted under 35 U.S.C. 154(b) by 0 days.

(21) Appl. No.: 13/286,668

(22) Filed: Nov. 1, 2011

Related U.S. Application Data

(63) Continuation-in-part of application No. 11/906,709, filed on Oct. 3, 2007.

(51) Int. Cl.
*E04D 13/00* (2006.01)

(52) U.S. Cl. ..... 52/12

(58) Field of Classification Search ..... 52/11, 12; 210/162, 474; D23/264
See application file for complete search history.

(56) References Cited

U.S. PATENT DOCUMENTS

| | | | |
|---|---|---|---|
| 546,042 | A | 9/1895 | Van Horn |
| 2,669,950 | A | 2/1954 | Bartholomew |
| 2,674,961 | A | 4/1954 | Lake |
| 3,950,951 | A | 4/1976 | Zukauskas |
| 4,404,775 | A | 9/1983 | Demartini |
| 4,497,146 | A | 2/1985 | Demartini |
| 4,604,837 | A | 8/1986 | Beam |
| 4,745,710 | A | 5/1988 | Davis |
| 4,757,649 | A | 7/1988 | Vahldieck |
| 4,796,390 | A | 1/1989 | Demartini |
| 5,010,696 | A | 4/1991 | Knittel |
| 5,406,755 | A | 4/1995 | Serano |
| 5,638,643 | A | 6/1997 | Demartini et al. |
| 5,640,809 | A | 6/1997 | Iannelli |
| 5,916,092 | A | 6/1999 | Chen |
| 6,016,631 | A | 1/2000 | Lowrie, III |
| 6,050,030 | A | 4/2000 | Wax, Sr. |
| 6,098,345 | A | 8/2000 | Demartini et al. |
| 6,151,837 | A | 11/2000 | Ealer, Sr. |
| 6,349,506 | B1 | 2/2002 | Pace et al. |
| 6,672,012 | B2 | 1/2004 | Bahroos et al. |
| 6,688,045 | B1 | 2/2004 | Pilcher |
| 6,732,477 | B1 | 5/2004 | Richard |
| 6,904,718 | B2 | 6/2005 | Fox |
| 7,198,714 | B2 | 4/2007 | Swistun |
| 2004/0244302 | A1 | 12/2004 | Neumann |
| 2005/0210758 | A1 | 9/2005 | Iannelli |
| 2005/0235577 | A1 | 10/2005 | Smith |
| 2006/0070304 | A1 | 4/2006 | Barnett |
| 2006/0107603 | A1 | 5/2006 | Brownridge |
| 2006/0225367 | A1 | 10/2006 | Stagni |
| 2006/0283097 | A1 | 12/2006 | Gregg |
| 2007/0094940 | A1 | 5/2007 | Pijanowski |
| 2007/0107323 | A1 | 5/2007 | Higginbotham |
| 2007/0214730 | A1 | 9/2007 | Cota |
| 2007/0214731 | A1 | 9/2007 | Bachman et al. |
| 2007/0220814 | A1 | 9/2007 | Faulks |
| 2008/0127575 | A1 | 6/2008 | Ealer |

FOREIGN PATENT DOCUMENTS

| | | | |
|---|---|---|---|
| JP | 10168990 | A | 6/1998 |

*Primary Examiner* — Christine T Cajilig
(74) *Attorney, Agent, or Firm* — Nelson Mullins Riley & Scarborough LLP

(57) ABSTRACT

A rain gutter cover comprising an elongate cover member adapted to be situated over an open trough of a rain gutter. The cover member has a first cover portion integrally extending into a second water directing portion following a rounded nose portion. An outer surface of the elongate cover member is adapted to substantially cause water passing thereover to adhere to its surface even under light rainfall conditions. The first portion includes ribs forming multiple channels configured to converge water on the first portion and facilitate initial water adherence to the nose area and to the surface of the second portion.

9 Claims, 11 Drawing Sheets

RAIN GUTTER COVER

CROSS-REFERENCE TO A RELATED APPLICATION

This application is a continuation-in-part of copending application Ser. No. 11/906,709, filed Oct. 3, 2007, which is relied upon and incorporated herein by reference.

FIELD OF THE INVENTION

The present invention relates generally to rain gutter covers. More particularly, the present invention relates to a rain gutter cover constructed to deflect leaves or other debris away from a rain gutter while directing rain water into the rain gutter.

BACKGROUND OF THE INVENTION

Rain gutters are constructed to collect water and are installed at the edge (periphery) of the roof of most residential structures in order to direct the water away from the building and its immediate surroundings. A problem of such rain gutters is that they also collect leaves, pine straw, and other debris, which can clog the rain gutter or otherwise prevent the gutter from performing its intended functions. As a result, the rain gutter performs ineffectively or, in some situations, not at all. At that point, the rain gutter must be cleared of debris.

In order to prevent debris from entering the gutters and to eliminate the need to clear the gutters, various rain gutter covers have been provided. Such covers are installed above the open trough of the gutter. They are designed to prevent debris from entering the gutters while allowing water to flow into the gutter's trough.

Covers offered in the past utilize "surface tension" to direct water around a rounded nose portion of the cover into the gutter's trough, while debris is deflected overboard to the ground. Surface tension is the linking exhibited by water molecules that are attracted to one another by intermolecular forces. As a result, rain water collects due to surface tension and is drawn around the cover's nose into the gutter's trough. Examples of such gutter covers may be seen in U.S. Pat. Nos. 4,796,390, 4,497,146, and 4,404,775, which are incorporated herein by reference in their entirety for all purposes.

"Wettability" is a cover's ability to cause water on the cover to film or "sheet," flowing in a manner resembling a uniform sheet of water. Wettability enhances the utility of surface tension so that water spreads out into a uniform sheet or film and is drawn around the cover's nose portion and into the gutter. Accordingly, covers have attempted to maximize wettability and surface tension properties so that rain flows into gutters in an improved manner.

Water adheres to a surface traversing its contour when the amount of rain water flowing is sufficient to maintain an unbroken (steady) stream. Only after an initial period of rain fall and only when rainfall rate is significant does there develop a sufficient film of water on the cover's surface to sustain continuous flow. As a result, effective gutter covers of the prior art have tended to have nose portions with a larger radius. The larger, more gentle turn generally requires a lower volume of water to achieve suitable wettability and flow than is the case with smaller radii.

While gutter covers having larger diameter nose portions may perform well, they pose certain objectionable considerations. For example, the gutter itself sometimes must be moved downward on the fascia of the house in order to allow sufficient space for the cover to be located between the gutter and the roof. In addition, the cover's upstream edge must generally be placed under the second or third course of shingles. Requiring relocation of the rain gutter is costly, while requiring placement higher on the roof than the first course of shingles may be aesthetically objectionable.

In addition, the color of large radius gutter covers generally needs to be matched with that of the roof shingles, thus requiring the provider to maintain a large inventory of different colors. Often, particularly where the roof pitch is shallow, the cover is installed on top of the second course of shingles using a butyl seal strip. While the seal-strip is effective in service, it can be difficult to remove and replace when or if the roof is reshingled. In addition, installation of those covers on other type of roofs, such as shake, tile, or slate, can be difficult or impossible.

In view of these considerations, attempts have been made to provide gutter covers with small radius nose portions. Because of the small radius, however, initial wetting of the lower water directing portion of the cover is more difficult to achieve. For example, at the initiation of rainfall and when the quantity of falling water is minimal, water may tend to accumulate in beads at the cover's nose. This water may then drip onto the gutter and run down its face instead of collecting into sheets and being drawn into the gutter as desired. Water dripping down the gutter's face (instead of into the trough) may cause what is known as "tiger striping." Water dripping down the gutter's face may also carry dirt and debris with it, a portion of which is deposited on the gutter's face. These undesired results can cause unsightly stains to appear on the face of the gutter.

An equally vexing problem associated with the dripping that occurs in minimal rainfall conditions is the tendency for icicles to form in cold weather. Gathering ice is undesirable in that it may seal off the slot through which water from the cover enters the gutter. Moreover, icicles over entrance ways create a danger to people standing or passing below them.

In most situations, as rain water accumulates on the roof of a structure, it begins to flow toward gutters at increasing rates. In order for a rain gutter cover to be able to direct rain water into a rain gutter, it must be constructed in a manner that is capable of handling these increasing rates. Otherwise, the rain water flowing over the cover will fail to adhere to the nose contour and will be jettisoned overboard to the ground.

SUMMARY OF THE INVENTION

The present invention recognizes and addresses the foregoing considerations, and problems encountered with covers of prior art constructions and methods. In this regard, one aspect of the invention provides a rain gutter cover comprising an elongate cover member adapted to be situated over an open trough of a rain gutter. The cover member has a first cover portion integrally extending into a second water directing portion following a rounded nose portion. An outer surface of the elongate cover member is configured such that water passing thereover will adhere to the cover surface under all rain conditions and not drip. The first portion includes multiple channels configured to converge water and facilitate initial wetting of the second portion.

According to another aspect, the present invention also provides a rain gutter cover comprising an elongate cover member adapted to be situated over an open trough of a rain gutter. The cover member has a first portion integrally extending into a second water directing portion following a rounded nose portion. The second water directing portion is terminated above the open trough of the rain gutter when the cover member is mounted thereover. The nose portion defines a plurality of indentations each between a respective pair of adjacent protrusions.

A further aspect of the present invention provides a rain gutter cover comprising an elongate cover member adapted to be situated over an open trough of a rain gutter. The cover member has a first portion integrally extending into a second water directing portion following a rounded nose portion. The second water directing portion is terminated above the open trough of the rain gutter when the cover member is mounted thereover. The first portion defines a plurality of spaced apart first channels, which are substantially parallel and extend in a flow direction. The second portion defines a plurality of spaced apart second channels, which are substantially parallel, extend in the flow direction, and are aligned with respective first channels in the flow direction. The nose portion contains a plurality of indentations between a respective pair of adjacent protrusions. The indentations are aligned with channels in the first portion and receive water delivered to them from those channels. Channels are configured to converge water, creating sufficient flow volume to facilitate traversing the nose and filming on the second portion, thus eliminating incipient dripping.

Another aspect of the present invention provides a rain gutter cover comprising an elongate cover member adapted to be situated over an open trough of a rain gutter. The cover member has a first portion integrally extending into a second water directing portion following a rounded nose portion. The second water directing portion is configured to terminate above the open trough of the rain gutter when the cover member is mounted thereover. In accordance with this aspect of the invention, the first portion defines a plurality of spaced apart vertical ribs configured to define a first spacing at an upstream location and a second spacing at a downstream location between adjacent vertical ribs. The first spacing is greater than the second spacing. As a result, the vertical ribs function to gather and converge water flow on the first portion and thereby facilitate initial water adherence around the rounded nose portion on the second portion.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
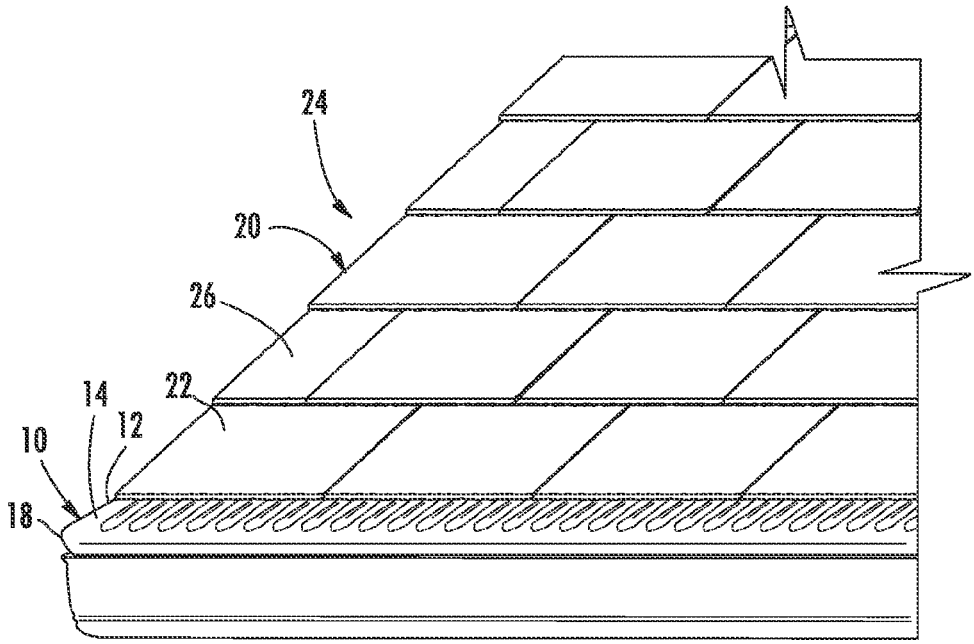
FIG. 1 is a perspective view of a rain gutter cover attached to the roof of a structure in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2A:
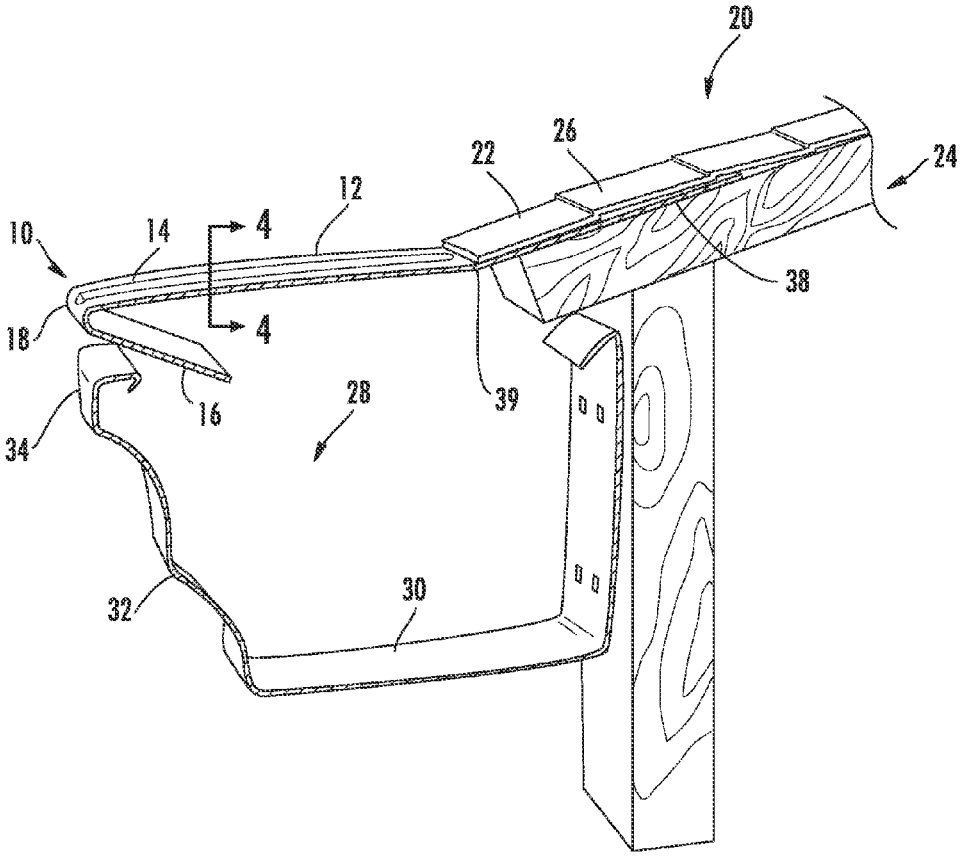
FIG. 2A is a cross-sectional perspective view of the rain gutter cover of FIG. 1 attached to the roof of a structure.

FIGS. 1 and 2A illustrate a rain gutter cover 10 constructed in accordance with an embodiment of the invention. Rain gutter cover 10 includes an elongate cover member 12 comprising a first portion 14 integrally extending into a second portion 16 about a rounded nose portion 18. A part of first portion 14 is attached to a roof 20 under a first course of shingles 22 so as to affix cover 10 to structure 24. Typically, such "attachment" is achieved by inserting the part of first portion 14 under the first course of shingles. The gutter cover is maintained in place by brackets.

Figure 2B:
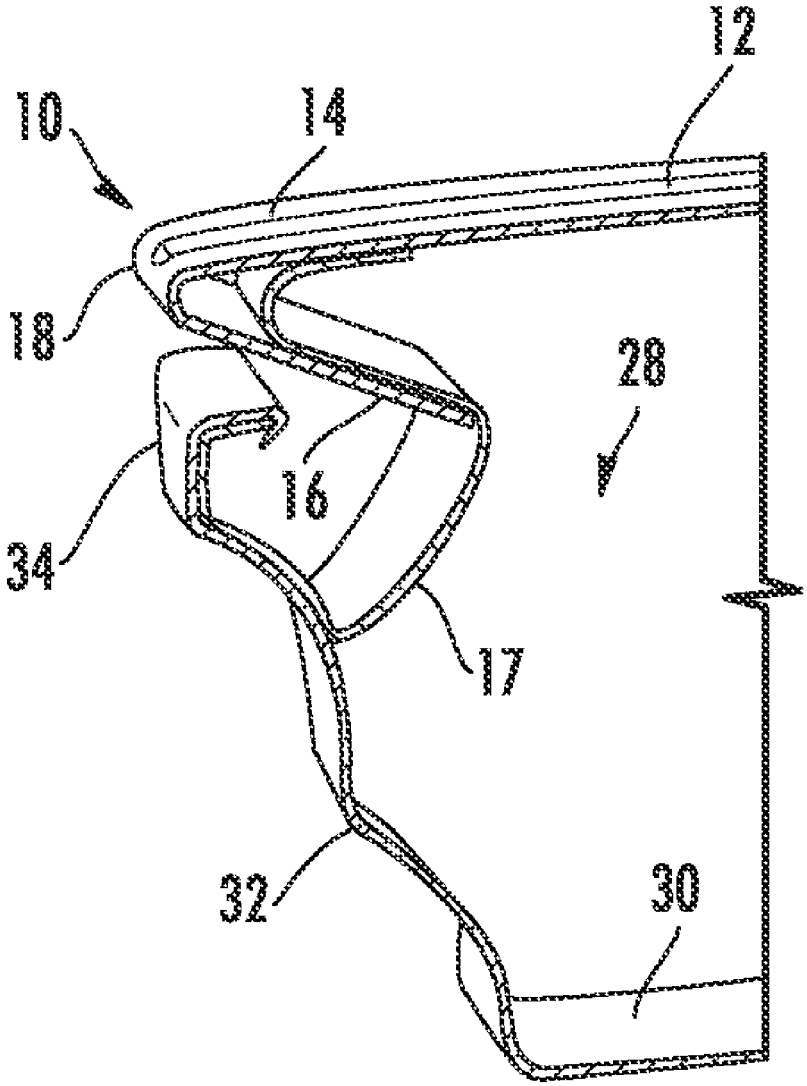
FIG. 2B is a cross-sectional fragmentary view of a portion of the rain gutter cover shown in FIG. 2A but showing an exemplary bracket for supporting the cover.

As shown most clearly in FIG. 2A, cover 10 is located above an open portion 28 of a trough 30 of a rain gutter 32. The outermost edge of rounded nose portion 18 preferably extends beyond the outside edge (the "bead") 34 of rain gutter 32. The radius of rounded nose portion 18 is preferably small enough to allow cover 10 to be installed under first course 22 of the roof's shingles to provide an adequate drainage pitch without the need to lower or otherwise relocate rain gutter 32. A radius within the range of an eighth of an inch (⅛" or 0.125") to three sixteenths of an inch (3/16" or 0.1875") should provide cover 10 with such a "low profile" configuration. Cover 10 may be constructed of sheet metal, plastic such as polyvinyl chloride ("PVC"), or any other suitable water resistant and/or non-absorptive material. FIG. 2B illustrates an exemplary bracket 17 that may be used to mount cover 10 in relation to gutter 32. Typically, a number of such brackets are located at the ends of cover panels and sometimes at places in between along gutter cover 10.

Placement under the first course of shingles has a number of advantages. For example, cover 10 will be less noticeable than many larger radius designs. This will obviate the need for matching the color of the cover with that of the roof shingles (which requires a larger inventory of an array of colors). Instead, the cover can be matched to the color of the gutter (which are supplied in relatively few colors). Moreover, the smaller overall size of the cover uses less material than many prior art configurations, thus saving on material costs. In addition, the need to nail through shingles or to use a seal strip for attachment to the shingles is eliminated. Attachment under the first course of shingles also simplifies installation on houses with less-commonly encountered types of roofs, such as shake, tile, and slate.

As noted above, previous attempts to provide a small radius gutter cover have encountered certain problems in light rain, or at the commencement of rain, in achieving initial wetting of the cover's lower portion.

Figure 3:
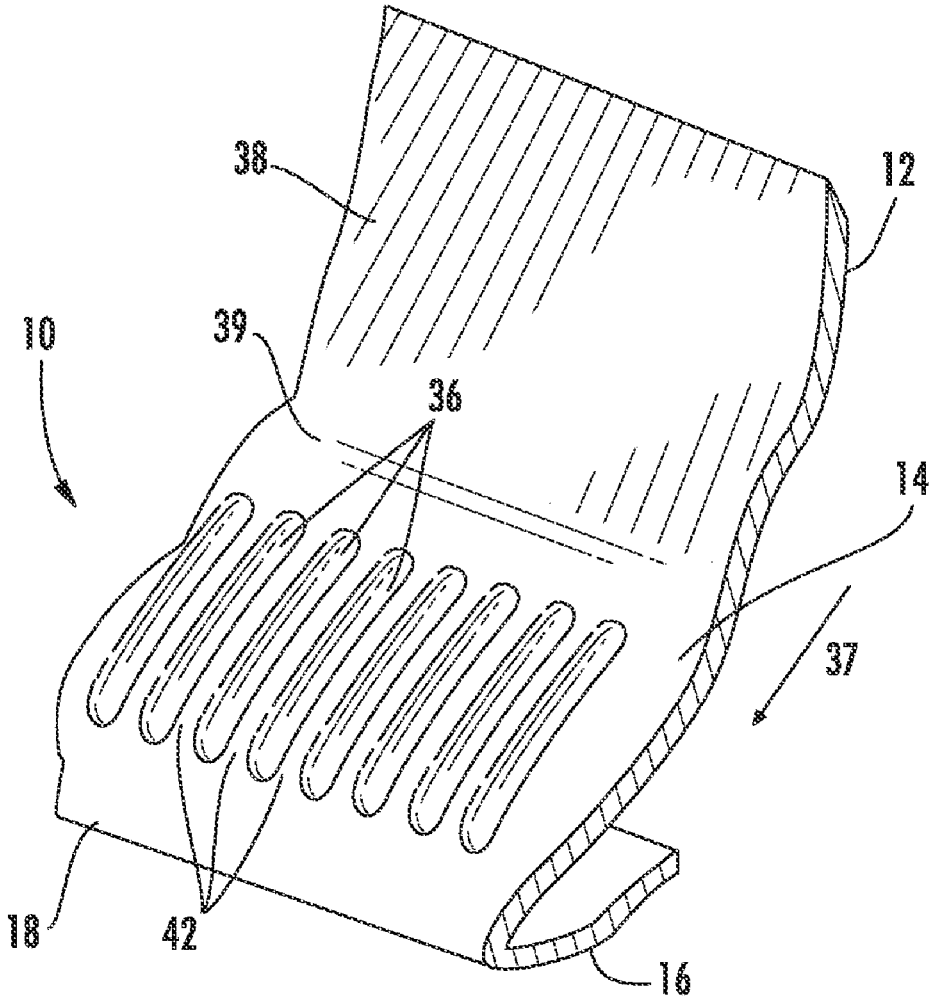
FIG. 3 is a fragmentary perspective view of a portion of the rain gutter cover of FIG. 1.
Figure 4:
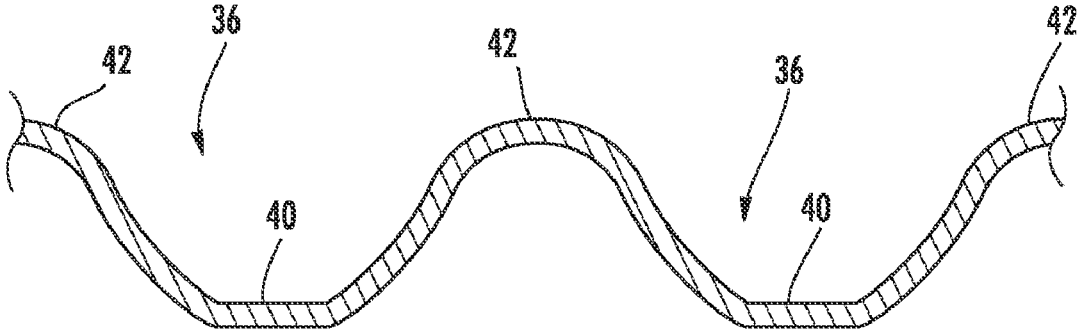
FIG. 4 is a cross-sectional view along line 4-4 of FIG. 2A.

Referring now also to FIG. 3, rain gutter cover 10 overcomes these problems by including a number of substantially parallel channels 36 defined in first portion 14 and extending in a flow direction as denoted by arrow 37. Preferably, channels 36 will begin immediately downstream of the part 38 of first portion 14 that is inserted under the first course of shingles (or, immediately downstream of the horizontal rib(s) in such embodiments). Typically, part 38 will be delimited by a bend line 39 at which the slope of the first portion changes to approximate that of the roof. As shown in FIG. 4, channels 36 are defined by a number of valleys 40 between respective pairs of peaks 42. Channels 36 and thus valleys 40 may increase in depth in the direction of arrow 37. Channels may be formed alternatively by pressing valleys from topside down or creating berms (protrusions) by pressing from underside up.

In operation and in reference to FIGS. 1-4, rain coming in contact with roof 20 begins to run down the roof toward cover 10. Rain then flows off roof 20 and onto first portion 14 of cover 10. When the rain begins to run over the part of first portion 14 defining channels 36 and peaks 42, peaks 42 help guide the rain into valleys 40 of channels 36. Thus, channels 36 help to converge any rain water running over the first portion 14 of cover 10. Of course, some of the rain will fall directly on the gutter cover. The illustrated configuration increases the volume of water at these locations, causing the water to flow in streams around nose portion 18 to second portion 16. This facilitates initial wetting of second portion 16, causing cover 10 to begin functioning sooner and in light rain. After the water has rounded nose portion 18 onto second portion 16, it flows into open trough 30 of rain gutter 32. Coatings, including suitable paint, may be applied to the entire surface of cover 10 in order to induce the flowing water to form a film so as to enhance the cover's wettability. Because the outermost edge of nose portion 18 extends beyond edge 34 of rain gutter 32, debris falls overboard to the ground and does not enter the gutter.

As a result of this arrangement, the occurrence of "tiger striping," as well as other effects caused when water drips from nose portion 18 onto the front surface of the gutter, is eliminated. In addition, it reduces the tendency for icicles to form and their attendant disadvantages to occur.

Figure 5:
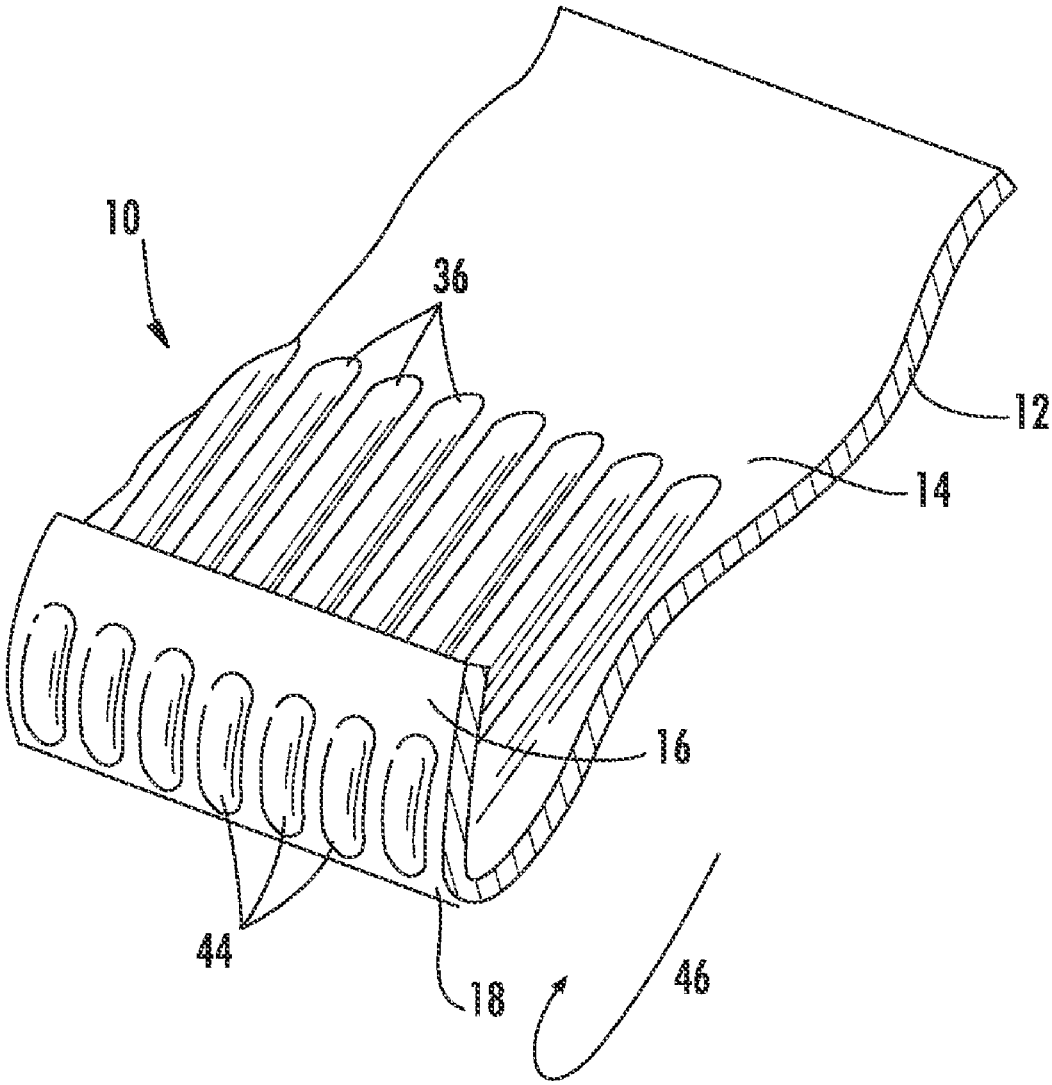
FIG. 5 is a fragmentary perspective view showing the underside of a rain gutter cover in accordance with an embodiment of the present invention.

FIG. 5 illustrates another embodiment of a gutter cover in accordance with the present invention. In this case, second portion 16 of cover 10 also includes a number of substantially parallel channels 44 extending in a flow direction (as denoted by arrow 46). Channels 44 are similar to channels 36 of first portion 14 (FIG. 3) and are preferably aligned with respective channels 36. In operation, water flows over roof 20 onto first portion 14 of cover 10 in a manner similar to that described above. When rain water rounds nose portion 18, channels 44 converge the water on second portion 16. This preserves the integrity of the high-volume streams created on the top of the cover. As such, water is less likely to break up into vulnerable droplets.

Figure 6A:
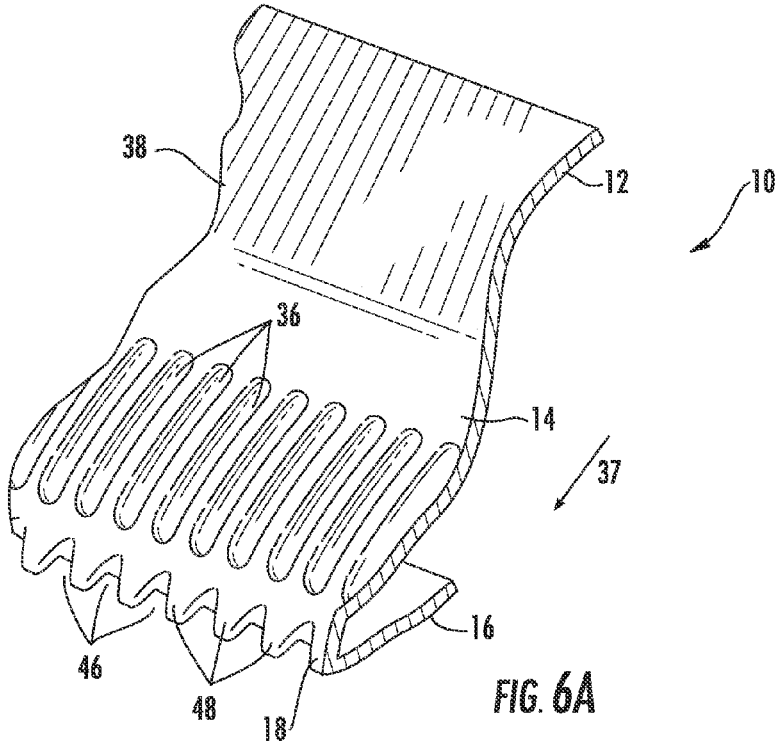
FIG. 6A is a fragmentary perspective view of a rain gutter cover in accordance with an embodiment of the present invention.
Figure 6B:
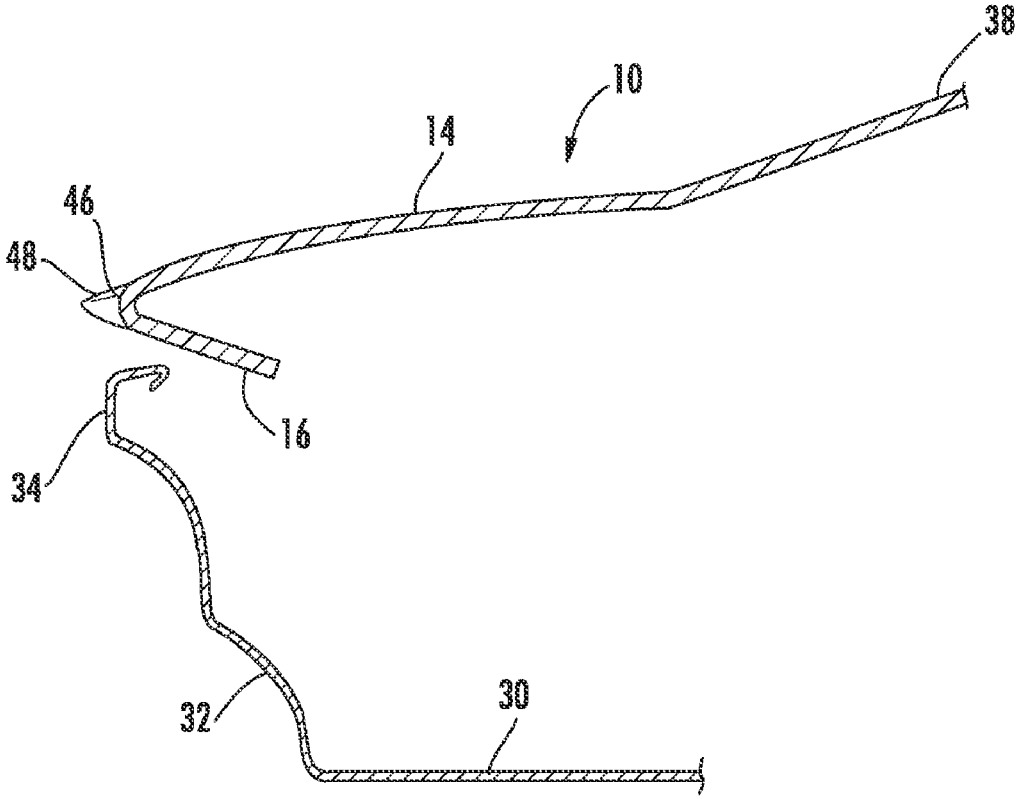
FIG. 6B is a cross-sectional fragmentary view of the rain gutter cover of FIG. 6A.

FIG. 6A illustrates a further embodiment in which rounded nose portion 18 of cover 10 contains alternating indentations 46 ("roots") and protrusions 48 ("teeth"). Each indentation 46 is defined between a respective pair of protrusions 48 as shown. In this embodiment, indentations 46 are U-shaped, but it should be understood by one of ordinary skill in the art that other shapes and configurations may be employed without departing from the scope and spirit of the present invention. (As used herein, "U-shaped" should be construed as U-shaped to V-shaped or anything in between.) As shown in FIG. 6B, the gutter cover is preferably configured in this embodiment such that protrusions 48 extend beyond the forward edge of the gutter.

In operation, water flows over roof 20 onto first portion 14 of cover 10 in a manner similar to that described above. Water is gathered in channels 36 and directed thereby to indentations 46 in nose portion 18. Accordingly, water will flow around nose portion 18 between protrusions 48. Initial wettability is enhanced by the fact the radius of the curved root surface is significantly larger than that at protrusions 48. In other words, the overall gutter cover maintains a small radius profile but the radius traversed by the water will be more like that of a gutter cover with a larger radius nose. Moreover, any dripping of water in this embodiment will be into the open trough of the rain gutter. Protrusions 48 act to prevent leaves and other debris from entering gutter 32 since they extend beyond the gutter bead.

While indentations 46 are shown to be relatively large in the drawings, benefits can be achieved using relatively small indentations. For example, indentations of only about 0.025-0.030 inches "deep" and a width of about ⅜ inch should achieve effective results.

Figure 7:
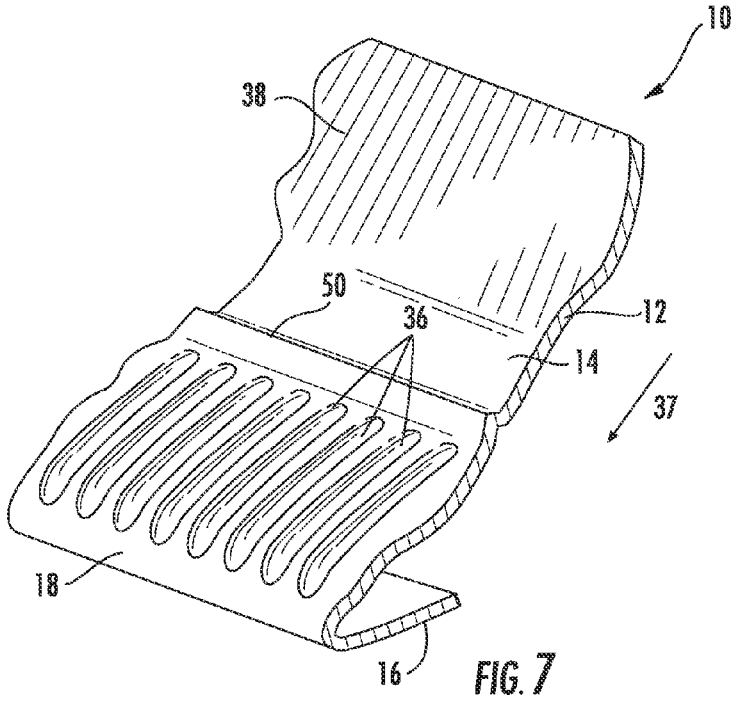
FIG. 7 is a fragmentary perspective view of a rain gutter cover in accordance with an embodiment of the present invention.

FIG. 7 illustrates an embodiment in which first portion 14 of cover 10 includes a horizontal rib 50 that runs the length of the cover. As shown, horizontal rib 50 is located downstream of the part 38 of first portion 14 that is installed under shingle first course 22 (FIG. 2), but upstream of channels 36. Preferably the vertical dimension of rib 50 will be sufficient to cause water cascading from the shingle surface to collide with it, thus slowing the velocity of the flowing water. This may be especially advantageous during high-flow periods (as in a downpour), reducing the chances that water will jettison overboard during extreme conditions. Rib 50 may also serve to advantageously disperse concentrated water streams, such as may be created by the presence of debris on the roof. As one skilled in the art will appreciate, it may be necessary to shorten the flow direction length of channels 36 in comparison with other embodiments in order to accommodate rib 50. Embodiments are also contemplated in which multiple parallel ribs are provided rather than a single horizontal rib as illustrated.

Figure 8:
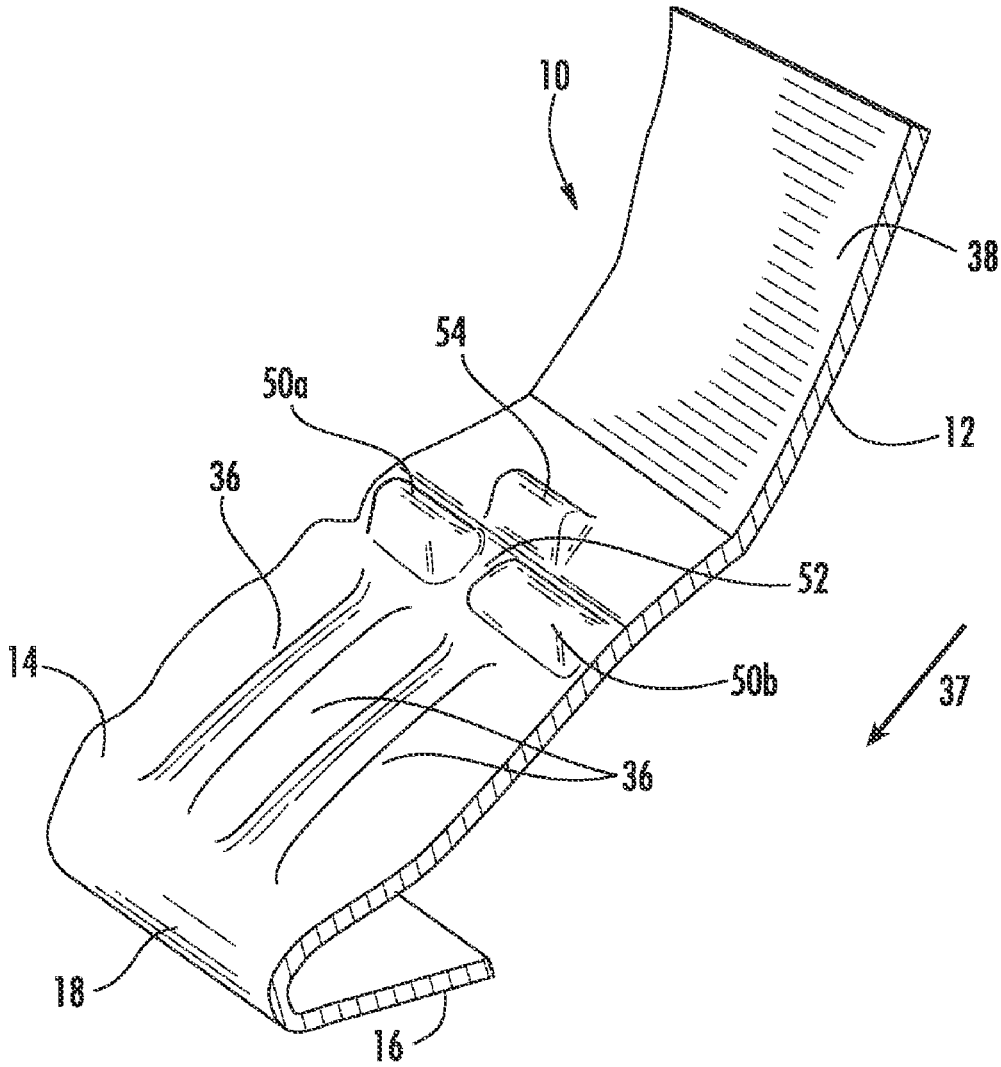
FIG. 8 is a fragmentary perspective view of a rain gutter cover in accordance with an embodiment of the present invention.

In addition, ribs may be formed in sections, with flat areas between sections to facilitate carrying shingle gravel and other particulate matter away, thus preventing build-up of material that could negatively impact the ribs' damming function. For example, FIG. 8 (also FIG. 10) illustrates an embodiment in which the rib is an interrupted continuum in which a small gap 52 is formed between longitudinal sections 50*a* and 50*b*. One or more short ribs 54 are located upstream of gap 52 to deny water the opportunity to flow unimpeded through the gap.

In operation, rain falls on roof 20 and begins to flow toward cover 10, increasing in volume with time. The rate at which the water travels may also begin to increase due to gravitational acceleration. Shortly after the water passes onto cover 10, it comes into contact with horizontal rib 50, which acts as a "speed bump" to decrease the rate at which the water is traveling before it enters channels 36. As a result, the rain water enters channels 36 at a more controlled rate allowing the channels to efficiently converge the water so that it may effectively round nose portion 18.

Figure 9:
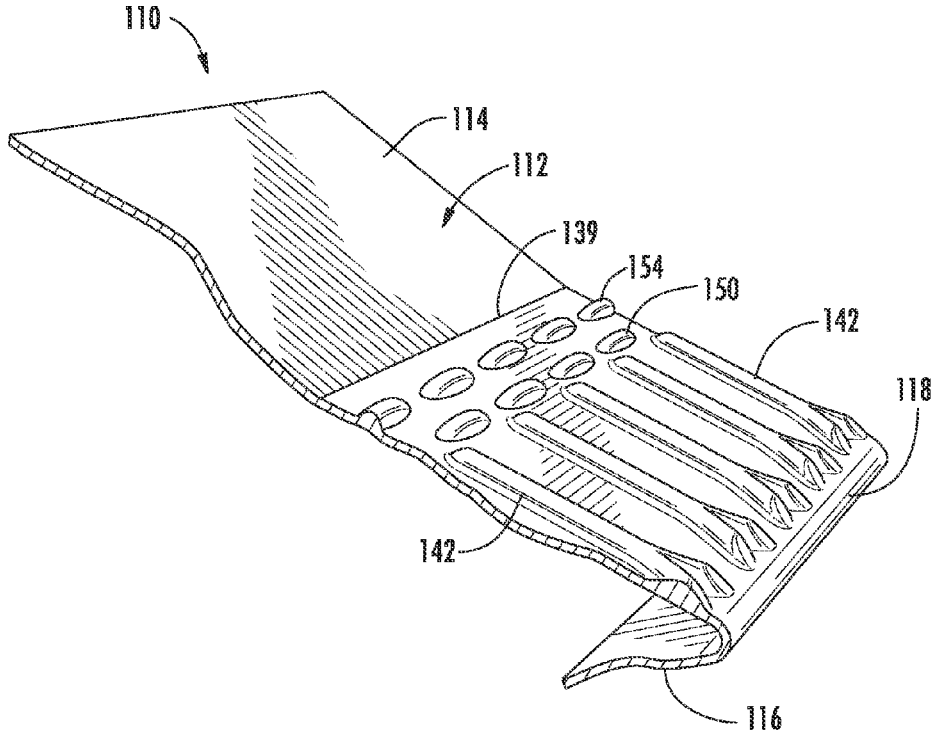
FIG. 9 is a fragmentary perspective view of a rain gutter cover in accordance with an embodiment of the present invention.
Figure 10:
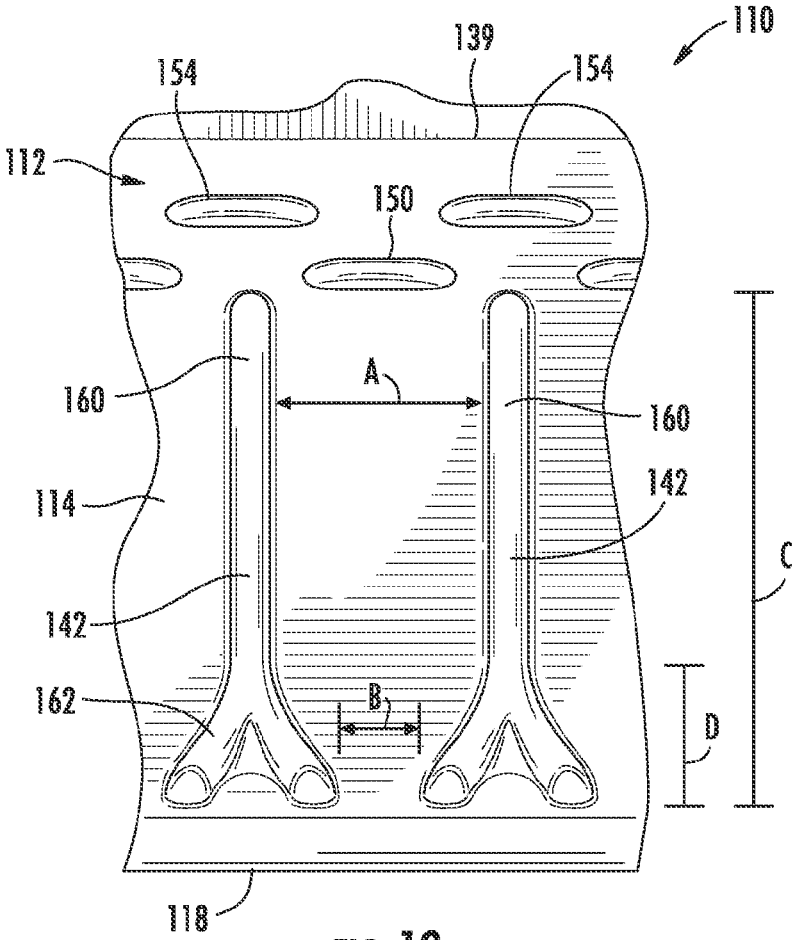
FIG. 10 is an enlarged fragmentary top view of the rain gutter cover of FIG. 9.
Figure 11:
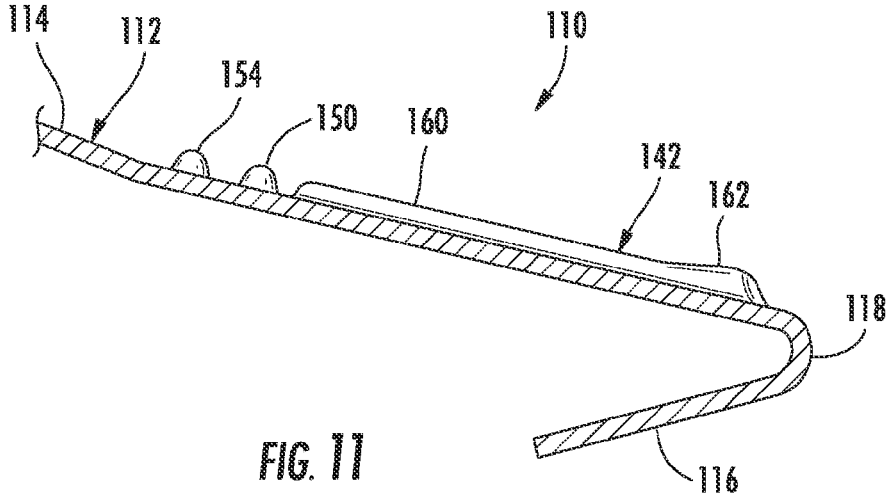
FIG. 11 is a cross-sectional side view of the rain gutter cover of FIG. 10.

Referring now to FIGS. 9-11, a rain gutter cover 110 constructed in accordance with a further embodiment of the present invention is shown. Rain gutter cover 110 includes an elongate cover member 112 comprising a first portion 114 integrally extending into a second portion 116 about a rounded nose portion 118. As with previous embodiments, a part of first portion 114 is preferably inserted under a first course of shingles so as to fix cover 110 to a house or other structure. In this regard, first portion 114 preferably defines a bend line 139 at which the insertion part is distinguished from the downstream part of first portion 114 used to slow and direct flow of water. Bend line 139 changes the slope of first portion 114 such that the insertion part will approximate the slope of the roof.

As with previous embodiments, the outermost edge of rounded nose portion 118 preferably extends beyond the outside edge ("bead") of the rain gutter when installed. Rounded nose portion 118 may have a radius within the range of an eighth of an inch (⅛" or 0.125") to three sixteenths of an inch (3⁄16" of 0.1875") to provide cover 110 with the desired "low profile" configuration. Like previous embodiments, rain gutter cover 110 may be constructed of any suitable material including sheet metal that has been appropriately coated or treated (as explained below), along with various plastics. Second portion 116 may preferably define a flat (i.e. unchanneled) surface, as shown.

In this embodiment, first portion 114 includes two rows of horizontal ribs 150 and 154 located downstream of bend line 139. (The term "horizontal" is used to indicate a direction transverse to the downstream flow direction. The term "vertical," used below, indicates a direction generally parallel to the flow direction.) As shown, ribs 150 and 154 may be configured as intermittent shorter ribs separated by gaps in the horizontal direction. Such gaps will advantageously allow particulate matter such as shingle gravel to pass through (along with the flowing water). In such embodiments, ribs 150 are preferably located downstream of the gaps between ribs 154.

Farther downstream of ribs 150 and 154, first portion 114 of cover member 112 defines a plurality of generally vertical ribs 142. As shown, ribs 142 define a first spacing A in their upstream direction and a second spacing B closer to rounded nose portion 118. Preferably, the spacing A may be in the range of 0.75 to 2 inches. The spacing B may preferably be in a range of about one-half inch (0.5") to one inch (1").

In the illustrated embodiment, the reduction in spacing between A and B is accomplished by configuring ribs 142 in an inverted "Y" shape. In particular, ribs 142 each have an upstream first portion 160 having an elongate shape. First portion 160 integrally extends into a downstream second portion 162 having two legs that diverge in the direction of nose portion 118. While the two legs of second portion 162 of a particular rib diverge from each other, one skilled in the art will appreciate that they converge toward those of adjacent ribs to provide the reduced spacing B. Generally, the overall length C of ribs 142 may preferably be in a range of about one and one-half inches (1.5") to two and one-half (2.5") inches. Of this, the length D defined by lower portion 162 will preferably be in the range of about three-quarters of an inch (0.75") to one and one-quarter inch (1.25").

As shown in FIG. 11, the height of second portion 162 is preferably slightly greater than that of first portion 160. For example, in one embodiment, first portion 160 may have a height of about three sixteenths of an inch (3⁄16") with second portion having a height of about five sixteenths of an inch (5⁄16").

It can be seen that second portions 162 preferably terminate very close to rounded nose portion 118. In addition, the lower ends of portions 162 may be "squared up" as shown to reduce dispersal of the flowing water that might otherwise occur at this location. Moreover, one skilled in the art will appreciate that ribs 142 may have other suitable shapes that provide the desired spacings A and B. For example, second portion 162 may be configured to have a triangular shape rather than diverging legs as shown.

In light rain or at the beginning of rain, the configuration of ribs 142 advantageously gathers raindrops into pools of sufficient volume to create water streams capable of adhering to rounded nose portion 118. In particular, the region between adjacent first portions 160 of ribs 142 serves as a water accumulation basin at which the water is collected. The spacing A between first portions 160 is wide enough such that water delivered to the nose is in streams of sufficient quantity even in very light conditions.

The spacing B between second portions 162 serves as an exit gate through which water is merged into continuous, agglomerated streams. In other words, the gathered water is "focused" (converged) at the "exit gate" to create momentum at the location of rounded nose portion 118. This focusing counteracts any tendency of the water to otherwise spread out, and augments braking provided by the horizontal ribs 150 and 154.

To further enhance the "wettability" characteristics of the cover, various techniques may be utilized. For example, the cover member may be formed of a substrate material having a conventional coating thereon (such as typical Kynar and acrylic-latex paints), further modified to enhance surface tension. In one exemplary approach, the cover member has a finely textured outer surface defining a multiplicity of water entrapment pits (or closed channels) to facilitate initial wetting of the cover member. Such cavities may be formed by appropriately abrading the coating. (Preferably, the coating should preferably be of a total thickness at least twice the nominal depth of the water entrapment cavities. For example, the total thickness of the coating may be at least 1.0 mm.) Adjacent cavities should be closely spaced, such that retained water in them connects at least partially via capillary action to form an overall film. Those cavities should preferably be formed on an exposed area of the first portion, on the rounded nose portion and on the water directing second portion.

Creating a multiplicity of water entrapment cavities spaced closely together desirably creates a water film from the first drops of a rain to fall on the cover surface. Such water entrapment cavities may be created by abrading a smooth surface coating to produce closed scratched channels and cavities of any conceivable configuration. All, however, should be capable of entrapping water. Arrayed in close proximity to one another, water in adjacent pools join together under capillary attraction to form the desired uniform surface film.

Another means of inducing early raindrops to assemble into the desirable film is to apply to the coil coating a layer of surfactant-based solution that promotes uniform wetting, one that induces water to spread in a film where normally it would stand in discreet droplets. Typical of such materials is a PPG Corporation product called "Shield," currently marketed as an aid to preventing accumulation of brake dust on automobile wheels. The life of such materials in weather is of the order of six months, long enough to maintain the desired filming condition while the surface tension properties of the underlying coating undergoes favorable change in response to weather exposure.

Still another means of inducing water filming is to arrive at time/temperature processing conditions during curing of coil coatings that yields a surface on which applied water does indeed spread as a film. Increasing curing time over that normally employed in coil processing makes for enhanced surface-tension performance in gutter cover applications.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

The invention claimed is:

1. A rain gutter cover comprising:

a. an elongate cover member adapted to be situated over an open trough of a rain gutter;

b. said cover member having a first portion integrally extending into a second water directing portion following a rounded nose portion;

c. said second water directing portion being configured to terminate above said open trough of said rain gutter when said cover member is mounted thereover;

d. said first portion defining a plurality of spaced apart vertical ribs configured to define a first spacing at an upstream location and a second spacing at a downstream location between adjacent ones of said vertical ribs, said first spacing being greater than said second spacing; and e. wherein said vertical ribs are operative to gather and converge water flow on said first portion and thereby facilitate initial water adherence around said rounded nose portion and on said second portion, said spaced apart vertical ribs each being configured having an elongate first portion upstream integrally extending into a second portion downstream, said first portions defining said first spacing and said second portions defining said second spacing.

2. The rain gutter cover of claim 1, wherein said second portions of said spaced apart vertical ribs each have diverging sides.

3. The rain gutter cover of claim 2, wherein said second portions of said spaced apart vertical ribs each comprise a pair of legs that diverge in the downstream direction.

4. The rain gutter cover of claim 1, wherein said spaced apart vertical ribs each have a length falling in a range of about 1.5 inches to 2.5 inches.

5. The rain gutter cover of claim 4, wherein said second portions of said spaced apart vertical ribs each have a length falling in a range of 0.75 inches to 1.25 inches.

6. The rain gutter cover of claim 1, wherein said first spacing falls in a range of approximately 0.75 inches to 2.0 inches.

7. The rain gutter cover of claim 6, wherein said second spacing falls in a range of approximately 0.5 inches to 1.0 inches.

8. The rain gutter cover of claim 1, wherein said cover member is treated to enhance water surface tension characteristics.

9. The rain gutter cover of claim 8, wherein said cover member is treated by applying a coating layer of surfactant-based solution.

* * * * *